United States Patent [19]

Lovejoy

[11] 4,450,058

[45] May 22, 1984

[54] METHOD FOR PRODUCING BRIGHT STAINLESS STEEL

[75] Inventor: Paul T. Lovejoy, Verona, Pa.

[73] Assignee: Allegheny Ludlum Steel Corporation, Pittsburgh, Pa.

[21] Appl. No.: 518,500

[22] Filed: Jul. 29, 1983

[51] Int. Cl.[3] ..... C25F 1/06

[52] U.S. Cl. ..... 204/145 R

[58] Field of Search ..... 204/145 R

[56] References Cited

U.S. PATENT DOCUMENTS

| | | | |
|---|---|---|---|
| 3,025,225 | 3/1962 | Snyder | 204/145 R |
| 3,043,758 | 7/1962 | Machu | 204/145 |
| 3,642,586 | 2/1972 | Shepard | 204/145 R |
| 4,012,299 | 3/1977 | Zaremski et al. | 204/145.5 |
| 4,363,709 | 12/1982 | Zaremski | 204/145 R |

*Primary Examiner*—T. M. Tufariello

*Attorney, Agent, or Firm*—Patrick J. Viccaro

[57] ABSTRACT

A method for producing bright surface quality stainless steel strip by continuous annealing cold-rolled strip in air followed by electrolytically descaling said annealed strip by making the strip the anode and applying electric current to the strip while the strip is in an electrolyte consisting essentially of an aqueous solution of at least one neutral salt which may be a chloride, sulfate or nitrate or an alkali metal, including aluminum, with the pH of the electrolyte being maintained between 1 and 7. In this manner, a scale-free, bright annealed-like surface is produced after air annealing without requiring annealing in a controlled atmosphere furnace.

8 Claims, No Drawings

METHOD FOR PRODUCING BRIGHT STAINLESS STEEL

BACKGROUND OF THE INVENTION

This invention relates to a process for producing stainless steel having a bright surface. More particularly, it relates to producing stainless steel having a bright annealed-like surface without the need for annealing in a controlled atmosphere.

Austenitic and ferritic stainless steel strip is conventionally produced by converting an ingot of the steel to a slab which, after conditioning, is rolled on a continuous hot-strip mill to produce a hot-rolled band of intermediate gauge. The hot-rolled band is then cold rolled to final gauge. After cold rolling to final gauge, the surface of the stainless steel strip is bright and glossy. For various final product applications, it is necessary to preserve this surface finish. After cold rolling, however, it is also necessary to anneal the cold-rolled strip to recrystallize the cold-rolled structure and obtain a stress-free product. For austenitic stainless steel, this generally requires annealing temperatures on the order of 1900° to 2000° F. and for ferritic stainless steel temperatures on the order of 1500° to 1600° F. To preserve the cold-rolled surface finish during such annealing, it is performed in a controlled atmosphere furnace wherein both the atmosphere and dew point are regulated. Specifically, the furnace atmosphere may be hydrogen, hydrogen and nitrogen or cracked ammonium (75% hydrogen+25% nitrogen). Controlled atmosphere furnaces of this type are termed "bright annealing furnaces". The strip is passed continuously through the furnace during the annealing operation. Bright annealing cannot be performed in a batch-type furnace wherein the strip is in coil form because the convolutions of the coil will weld together during annealing to impair the surface finish of the strip.

What is needed is a method to produce bright surface stainless steel of comparable surface quality to bright annealed stainless steel which is produced by conventional practices using a controlled atmosphere furnace. It is desirable to do so without capital cost of extensive new equipment, but through modification of existing facilities and processes.

SUMMARY OF THE INVENTION

In accordance with the present invention, a method is provided for processing stainless steel after cold rolling to produce a scale-free, bright surface. The method comprises continuously annealing the strip in air, and then descaling the air-annealed strip by making the strip an anode and applying an electric current to the strip in an electrolyte. The electrolyte consists essentially of an aqueous solution of at least one neutral salt selected from the group consisting essentially of chloride, sulfate and nitrate of an alkali metal including ammonium. The pH of the electrolyte is maintained between 1 and 7.

It is a primary object of the present invention to provide a method for producing stainless steel strip having a scale-free, bright annealed-like surface without requiring the step of annealing in a controlled atmosphere furnace.

A more specific object of the invention is to provide a method for producing a bright surface on stainless steel wherein the stainless steel strip may be continuously annealed in air followed by an electrolytic descaling treatment wherein the cold-rolled surface finish is preserved.

These and other objects of the invention, as well as a more complete understanding thereof, may be obtained from the following description and specific examples.

DETAILED DESCRIPTION OF THE PREFERRED EMBODIMENTS

Broadly, in the practice of the invention, stainless steel strip, after cold rolling to final gauge, is continuously annealed in air and following such annealing, the annealed strip is subjected to an electrolytic descaling treatment. Annealing is conducted in air within the temperature range of 1350° to 2000° F. (732° to 1093° C.), and preferably 1350° to 1650° F. (732° to 882° C.).

In the descaling treatment, the annealed strip is made the anode and direct electric current is applied thereto with the strip being in an electrolyte consisting essentially of an aqueous solution of at least one neutral salt selected from the group consisting of a chloride, sulfate and nitrate of an alkali metal, including ammonium. The pH of the electrolyte is maintained between 1 and 7, preferably between 2 and 3.5. The neutral alkali metal salt is preferably sodium sulfate. During the electrolytic treatment, current is applied at a current density of 0.1 to 0.5 A/in$^2$ (1.55 to 7.75 A/dm$^2$) and the current is applied for 10 to 120 seconds, particularly for ferritic grades.

Electrolyte temperatures are usually in the range of 120° to 200° F. (48.9° to 93.3° C.), however, for the present invention it is preferred that the temperature range from 120° to 185° F. (48.9° to 85° C.), and even more preferably 120° to 145° F. (48.9° to 62.8° C.). The neutral salt electrolyte may have a solution concentration of 7–25%, and preferably 15–25%, and particularly so when the electrolyte is an aqueous solution of sodium sulfate.

Upon the conclusion of the electrolytic treatment, the surface of the stainless steel strip approximates that which it exhibited after cold rolling and prior to annealing. After the descaling treatment, the strip in the conventional manner may be temper rolled as desired for flatness.

In order to more completely understand the present invention, the following Examples are presented.

EXAMPLE I

As a specific example of the practice of the invention, duplicate samples of AISI Types 430 and 434 stainless steels of cold-rolled strip in the form of 3-inch by 6-inch (7.6 by 15.2 cm) panels were placed in an electric furnace and heated in air for five minutes at a temperature of 1500° F. (815.6° C.). Upon cooling to room temperature, the panels exhibited a purple scale. The annealed panels were electrolytically descaled by making them the anode in an aqueous electrolyte bath of sodium sulfate containing 200 grams of sodium sulfate per liter, with the bath having a pH of 2.5 and a temperature of about 125° F. (51.5° C.). The electrolytic treatment was conducted for 60 seconds at a current density of 0.5 A/in$^2$ (7.75 A/dm$^2$). Upon completion of this descaling treatment, all the samples exhibited a scale-free, bright surface comparable to the surface after cold rolling and prior to annealing.

EXAMPLE II

As an additional specific example of the practice of the invention, AISI Type 430 stainless steel cold-rolled strip was continuously annealed in air for one minute at a temperature of 1750° F. (953° C.) in a conventional, commercial continuous-annealing furnace. After annealing and cooling, the strip exhibited a purple scale identical to the samples in Example I. Samples of this annealed strip were electrolytically descaled by making them the anode in an aqueous electrolyte bath of sodium sulfate containing 200 grams of sodium sulfate per liter, with the bath having a pH of 2.1 and a temperature of about 125° F. (51.5° C.). The electrolytic treatment was conducted for 11 seconds at a current density of 0.21 $A/in^2$ (3.26 $A/dm^2$). Upon completion of this descaling treatment, all the samples exhibited a scale-free, bright surface comparable to the surface after cold rolling and prior to annealing.

As demonstrated by the specific examples, with the practice of the invention it is possible to produce stainless steel strip of bright-annealed surface quality without the expense of requiring the use of a controlled atmosphere, continuous annealing furnace. With the combination of continuous annealing in air and the described electrolytic descaling practice, the scale formed during annealing may be effectively removed to provide a surface comparable to the strip surface after cold rolling and prior to annealing.

Although several embodiments of the present invention have been shown and described, it will be apparent to those skilled in the art that modifications may be made without departing from the scope of the invention.

What is claimed is:

1. A method for processing stainless steel strip after cold rolling to produce a scale-free, bright surface, said method comprising continuously annealing said strip in air, then descaling said annealed strip by making said annealed strip an anode and applying electric current to said strip with said strip in an electrolyte consisting essentially of an aqueous solution of at least one neutral salt selected from the group consisting of chloride, sulfate and nitrate of an alkali metal including ammonium with the pH of said electrolyte being maintained between 1 and 7.

2. The method of claim 1 wherein said neutral alkali metal salt is sodium sulfate.

3. The method of claim 1 wherein said annealing is conducted within the temperature range of 1350° to 2000° F.

4. The method of claim 1 wherein said annealing is conducted within the temperature range of 1350° to 1650° F.

5. The method of claim 1 wherein said current is applied at a current density of 0.1 to 0.5 amperes per square inch.

6. The method of claim 1 wherein said current is applied for 10 to 120 seconds.

7. The method of claim 1 wherein the temperature of the electrolyte is 120° to 145° F.

8. A method for processing stainless steel strip after cold rolling to produce a scale-free, bright surface, said method comprising continuously annealing said strip in air and following said annealing, descaling said annealed strip by making said annealed strip an anode and applying electric current at a current density of 0.1 to 0.5 amperes per square inch to said strip for 10 to 120 seconds with said strip in an electrolyte consisting essentially of an aqueous solution of sodium sulfate with the pH of said solution being maintained between 2 and 3.5, and the electrolyte temperature ranging from 120° to 140° F.

* * * * *